United States Patent [19]

Lewis

[11] Patent Number: 4,578,843

[45] Date of Patent: Apr. 1, 1986

[54] STRAP CONNECTOR AND METHOD OF MAKING THE SAME

[75] Inventor: Robert D. Lewis, Niles, Mich.

[73] Assignee: HSC Corporation, Buchanan, Mich.

[21] Appl. No.: 619,293

[22] Filed: Jun. 11, 1984

[51] Int. Cl.[4] ..... A44B 11/25

[52] U.S. Cl. ..... 24/580; 24/319; 24/575; 24/590

[58] Field of Search ..... 24/580, 581, 590, 575, 24/597, 308, 310, 319

[56] References Cited

U.S. PATENT DOCUMENTS

| | | | |
|---|---|---|---|
| 302,421 | 7/1884 | Mosier | 24/590 |
| 796,414 | 8/1905 | Chayes | 24/319 |
| 798,253 | 8/1905 | Basch | 24/590 |
| 1,830,660 | 11/1931 | Johnson | 24/580 |
| 3,765,062 | 10/1973 | Cruse | 24/575 |
| 3,979,801 | 9/1976 | Tareau | 24/580 |
| 4,000,544 | 1/1977 | Fildan | 24/590 |
| 4,161,806 | 7/1979 | Hennisse et al. | 24/580 |

*Primary Examiner*—Victor N. Sakran

*Attorney, Agent, or Firm*—Eugene C. Knoblock

[57] ABSTRACT

A strap connector and method of making the same. The connector includes a latch socket and a latch pin which have an interference fit. The socket and pin form a connector which has a hinge action. The method of forming the connector includes injection molding the socket of the connector onto the end of a strap.

5 Claims, 8 Drawing Figures

STRAP CONNECTOR AND METHOD OF MAKING THE SAME

SUMMARY OF THE INVENTION

This invention relates to a strap connector and a method for making the same.

The strap connector of this invention includes a socket member and a pin member which fits into the socket member. The socket member has a slot receiving a neck of the pin with clearance to permit pivotal movement of the pin within the socket member. The pin and socket are secured to the ends of straps which are to be connected.

The method of making the socket member of the strap connector includes the steps of inserting the end of a woven or plastic strap such as a knit elastic braid strap into a mold in which a core is mounted, and injecting plastic material into the mold so that a plastic socket is formed around and bonded to the inserted end of the strap.

It is an object of this invention to provide a novel, economical and useful strap connector and a method of making the same.

Another object is to provide a strap connector which accommodates a pivotal or hinge connection of strap ends.

Another object is to provide a strap connector which will not disconnect during normal usage.

Another object is to provide a method for making a strap connector which bonds the socket member of the connector to an end of a strap.

Other objects of this invention will become apparent upon a reading of the following description.

DESCRIPTION OF THE PREFERRED EMBODIMENT

The preferred embodiment illustrated is not intended to be exhaustive or to limit the invention to the precise form disclosed. It is chosen and described to explain the principles of the invention and its application and practical use to thereby enable others skilled in the art to utilize the invention.

Figure 1:
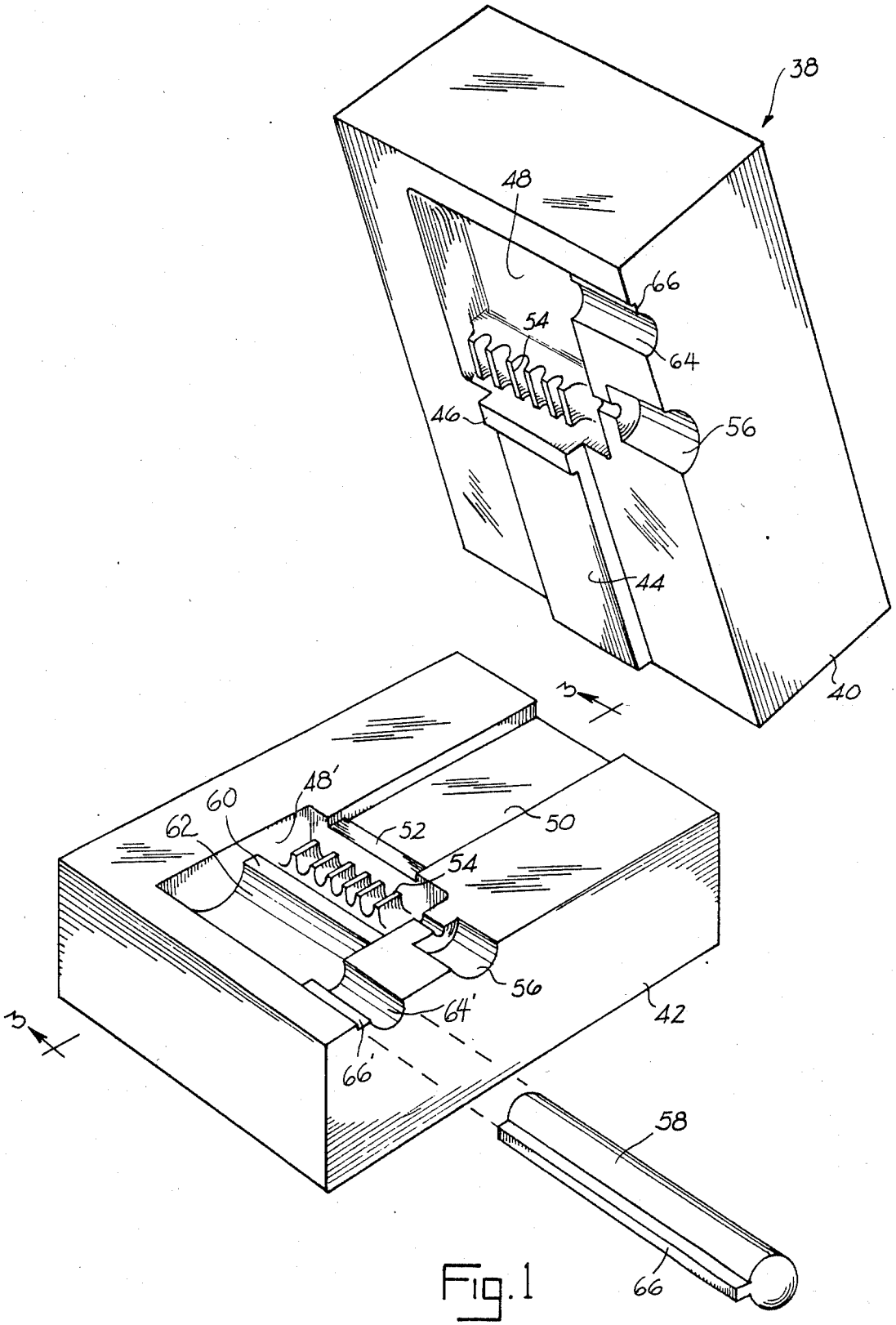
FIG. 1 is a perspective view of a mold used in the method of making the socket member of the strap connector of this invention.
Figure 2:
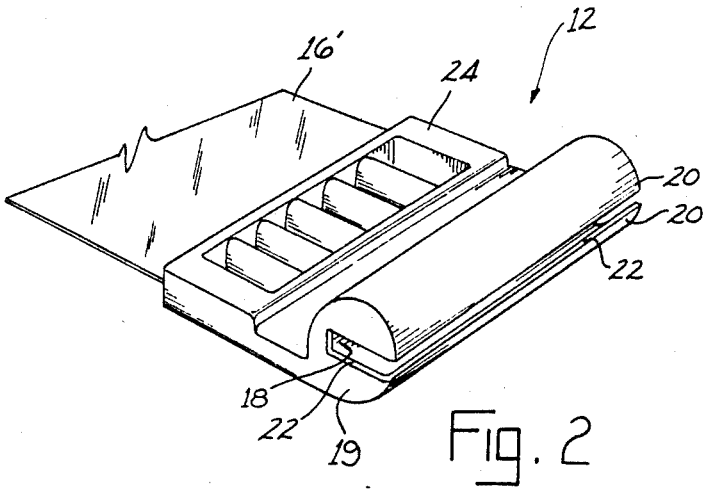
FIG. 2 is a perspective view of a socket member.
Figure 3:
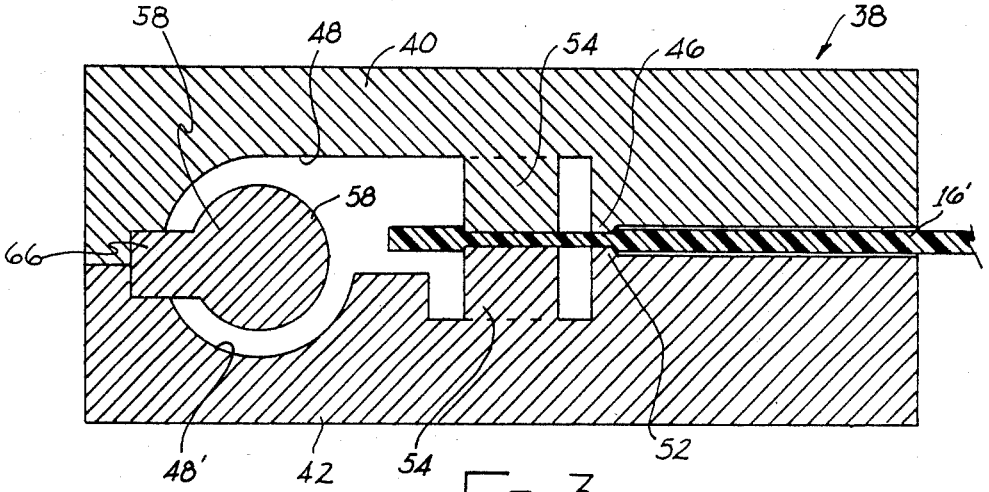
FIG. 3 is a sectional view of the mold of FIG. 1 taken on line 3—3 and showing a strap inserted into the mold.
Figure 4:
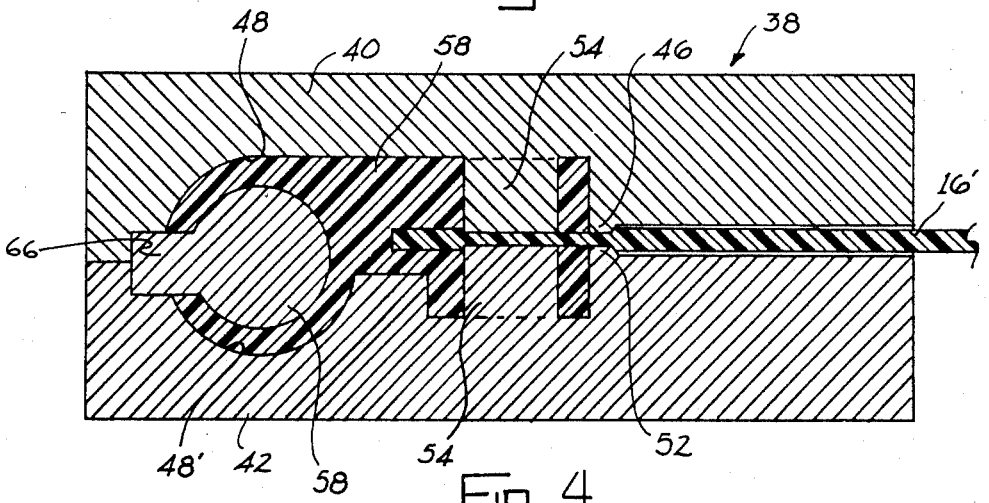
FIG. 4 is a sectional view similar to FIG. 3 showing material injected into the mold to form a socket member of a connector upon the end of strap.
Figure 5:
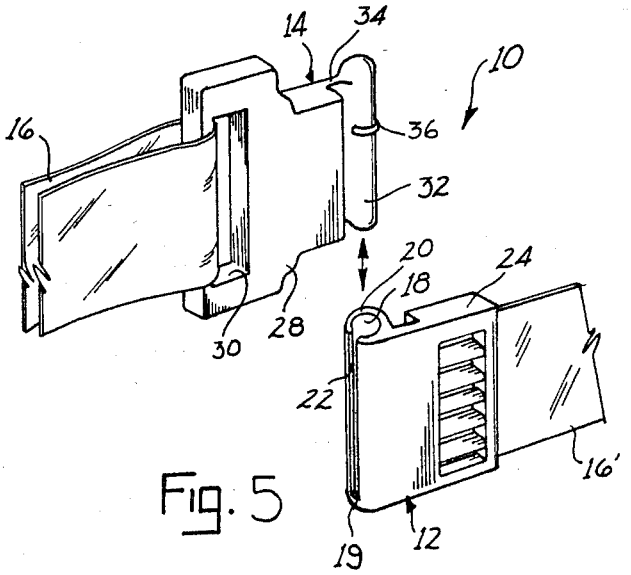
FIG. 5 is a perspective view of the parts of the connector shown in adjacent but disconnected position.
Figure 6:
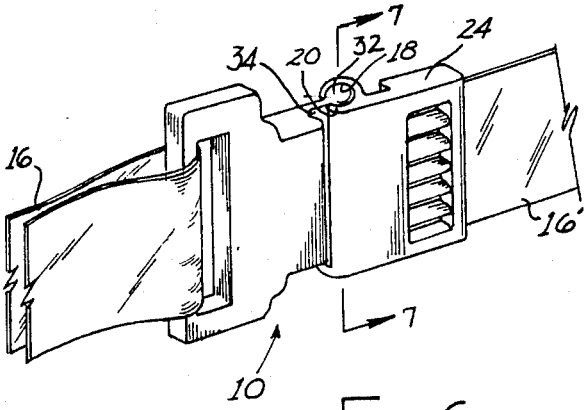
FIG. 6 is a perspective view of the strap connector connecting two srap ends.
Figure 7:
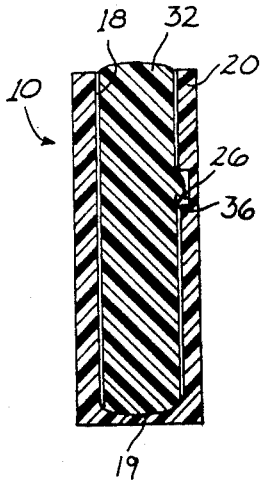
FIG. 7 is a sectional view taken along line 7—7 of FIG. 6.
Figure 8:
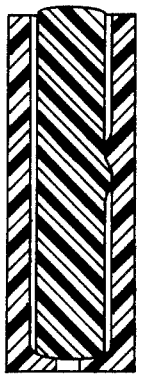
FIG. 8 is a sectional view taken along line 7—7 of FIG. 6 and illustrating a modified embodiment of the invention.

The strap connector 10 of this invention, shown in FIGS. 2,5–7, includes a socket member 12 and a pin member 14. Socket member 12 and pin member 14 are secured to the ends of straps 16' and 16 respectively. Socket member 12 has a cylindrical, transverse bore or recess 18 formed therein defined by a parttubular wall 20. A part circumferential recess 26 as seen in FIG. 7 or a projection 27 as seen in FIG. 8 may be formed at the inner face of wall 20 intermediate its ends as seen in FIG. 7. A slot 22 separates the adjacent edges of wall 20 and is open at one end to receive pin member 14 as described below. Socket member 12 has an end wall 19. Socket member 12 is secured to the end of strap 16' at a body portion 24 in a manner which encloses and anchors the strap end within the body portion 24. Pin member 14 includes a body 28 having a strap anchoring opening 30 formed in one end thereof. At the opposite end of body 28 a transverse part-cylinder pin 32 projects from a narrow neck portion 34. A small part-circumferential projection 36 is be formed on cylinder 32 intermediate its ends. Strap 16 is passed through opening 30 of member 14 and doubled back on itself to fit through a fastener (not shown) to provide for length adjustment of the strap 16.

The connector may be used on a pair of straps each secured at one end to a face mask or any selected type of device. In use, securement of strap connector pin member 14 to socket member 12 preferably involves sliding cylinder 32 endwise into socket bore 18 until it engages socket wall 19 or until pin projection 36 seats in recess 26 of the socket member, or until pin projection 36 passes inwardly of projection 27 of the socket member. The wall 20 of the socket is sufficiently resilient to yield slightly to accommodate interconnection and disconnection of the pin and socket, and in the FIG. 8 construction a slight clearance is provided between the pin and socket. Narrow neck portion 34 of the pin fits in slot 22 of the socket member. The width of slot 22 is slightly greater than the thickness of neck 34 to accommodate limited pivotal movement of the cylinder 32 within bore 18 of the socket.

The method of making strap connector 12 entails the use of a mold 38 having opposed parts 40 and 42. Mold part 40 includes a longitudinal portion 44 which projects from one surface and terminates in a transverse raised shoulder part 46 adjacent to a mold cavity or recess 48. Raised part 44 registers with and fits into a longitudinal recess 50 formed in the confronting face of mold part 42 when the mold halves are secured together in register. A rib 52 is formed at the end of recess 50 adjacent to mold cavity 48' and registers with part 46 when the mold halves 40,42 are secured together. Mold halves 40,42 have spaced ribs 54 projecting from cavities 48,48'. Ribs 54 of the mold halves register and substantially abut when the mold halves are secured together. Mold cavity 48' has a rib 60 defining part of a curved wall 62 of mold cavity 48'. A reduced semicircular opening 64' and a communicating inset ledge surface 66' are formed in mold part 42 to communicate with mold cavity 48',62. Semi-circular opening 64 and a communicating inset ledge 66 are formed in mold part 40. Openings 64,64' and 66,66' register when the mold parts 40,42 are assembled in register. A cylindrical core 58 is removably positioned in openings 64,64' and includes a longitudinal projection 68 received between ledges 66,66'. Core 58 is slideable in and closes the mold opening 64,64', and is of a size to define socket 18 and mouth 22 of the socket member 12. A fluid inlet 56 is formed in mold 38 by registering openings in the mold parts and is in fluid communication with cavities 48,48'.

The method of making a strap connector 12 includes placing a strap end 16', such as an end of a knit elastic braid strap, endwise within recess 50 and the cavity of mold part 42 to project between to ribs 54 so that the strap will be clamped at 46,52 and between opposed ribs 54 when the mold is closed. Core 58 is then positioned in the mold recesses 64,66. When strap end 16' is properly positioned and the mold is closed with core 58 positioned to substantially span the mold cavity a fluid polypropylene, polyester or other thermoplastic material is injected through inlets 56 to fill cavities 48,48'. When plastic 58 sets, strap 16 is encased and anchored or bonded within the plastic which forms a strap connector or socket member 12 with its bore 18, wall 19 and slot 22. The core 58 can be removed from the formed plastic part after the plastic has set and removed from the mold.

Pin member 14 may be molded conventionally independently from a strap. It is possible to use a multiple cavity mold to simultaneously mold a pin member 14 and a socket member 12.

It is to be understood that the invention is not to be limited by the terms of the above description but may be modified within the scope of the appended claims.

I claim:

1. A connector for releasably anchoring strap portions, comprising a molded plastic socket member and a molded plastic pin member, each carried by an end of a strap, said socket member being bonded on an end of one strap, said socket member having an elongated transverse bore formed in a portion thereof spaced from said bonded strap portion, said bore being defined by complementary arcuate resilient walls interrupted by an interior recess intermediate its ends, said pin member including a body having a reduced neck portion and a transverse cylindrical portion of a diameter receivable in said bore and projecting from said neck portion, said cylindrical portion of said pin including a projection intermediate its ends, said transverse bore having a longitudinal slot, said cylindrical pin portion fitting rotatably in said socket bore and said projection seating in said interior socket recess and said reduced neck portion fitting in said slot between said arcuate socket walls, whereby said strap portions are connected for limited pivotal movement and releasably when said pin member fits in said socket member, said socket bore and pin cylindrical portion including a part circumferential recess and a part circumferential projection respectively adapted to interfit.

2. The connector of claim 1, wherein said arcuate socket member wall has limited resilience.

3. The connector of claim 1, wherein a stop part is formed at one end of said transverse socket bore.

4. The connector of claim 1 wherein said socket is formed of plastic material bonded to a strap.

5. The connector of claim 1 wherein a strap is formed of plastic material and said socket is formed of plastic and is bonded to said plastic strap.

* * * * *